US008888508B2

(12) United States Patent
Chen

(10) Patent No.: US 8,888,508 B2
(45) Date of Patent: Nov. 18, 2014

(54) BOARD-TO-BOARD CONNECTOR

(71) Applicant: Aces Electronics Co., Ltd., Jhongli (TW)

(72) Inventor: Chun-Yuan Chen, Taipei (TW)

(73) Assignee: Aces Electronics Co., Ltd., Jhongli, Taoyuan County (TW)

( * ) Notice: Subject to any disclaimer, the term of this patent is extended or adjusted under 35 U.S.C. 154(b) by 19 days.

(21) Appl. No.: 13/854,592

(22) Filed: Apr. 1, 2013

(65) Prior Publication Data

US 2013/0260589 A1 Oct. 3, 2013

(30) Foreign Application Priority Data

Apr. 3, 2012 (TW) ..... 101206063 U

(51) Int. Cl.
*H01R 12/00* (2006.01)
*H01R 12/71* (2011.01)
*H01R 24/84* (2011.01)

(52) U.S. Cl.
CPC ..... *H01R 12/712* (2013.01); *H01R 12/716* (2013.01); *H01R 24/84* (2013.01)
USPC ..... 439/74

(58) Field of Classification Search
CPC ..... H01R 23/725; H01R 23/722
USPC ..... 439/74, 70–73, 330–331, 525–526
See application file for complete search history.

(56) References Cited

U.S. PATENT DOCUMENTS

| | | | | |
|---|---|---|---|---|
| 5,800,186 | A * | 9/1998 | Ramirez et al. | 439/74 |
| 5,803,752 | A * | 9/1998 | McHugh | 439/74 |
| 6,638,106 | B1 * | 10/2003 | Wu | 439/567 |
| 6,764,314 | B1 * | 7/2004 | Lee | 439/65 |
| 8,257,095 | B2 * | 9/2012 | Akai et al. | 439/74 |
| 2013/0260587 | A1 * | 10/2013 | Chen | 439/284 |
| 2013/0260588 | A1 * | 10/2013 | Chen | 439/284 |

* cited by examiner

*Primary Examiner* — Phuongchi T Nguyen
(74) *Attorney, Agent, or Firm* — Muncy, Geissler, Olds & Lowe, P.C.

(57) ABSTRACT

A board-to-board connector made in the form of the combination of a male connector and a female connector is disclosed to include an electrically insulative connector body including a long rectangular mating part, a receptacle part and a plug part respectively located at two opposite sides of the long rectangular mating part, a recessed receiving chamber defined between the long rectangular mating part and the receptacle part and a recessed mating chamber defined between the long rectangular mating part and the plug part, terminal grooves located at the receptacle part, a positioning protruding member located at the plug part and a recessed mating chamber surrounded by the long rectangular mating part and the positioning protruding member, first conducting terminals respectively mounted in the terminal grooves, and second conducting terminals mounted in the positioning protruding member of the plug part of the electrically insulative connector body.

12 Claims, 6 Drawing Sheets

BOARD-TO-BOARD CONNECTOR

This application claims the priority benefit of Taiwan patent application number 101206063, filed on Apr. 3, 2012.

BACKGROUND OF THE INVENTION

1. Field of the Invention

The present invention relates to electrical connector technology and more particularly, to a board-to-board connector made in the form of the combination of a male connector and a female connector so that two identical board-to-board connectors can be used as a mating pair for connection between two electronic devices, facilitating the manufacturing and installation costs.

2. Description of the Related Art

Following fast development of computer, network and electronic information technologies, various advanced computers, notebooks, tablet computers, smart phones and many other advanced electronic devices and systems have been well developed and widely used for different applications. Further, it is the market trend to create electronic devices having light, thin, short and small characteristics. In consequence, circuit board electronic components must be made extremely strong, small and precise.

Further, many different male and female mating electrical connectors may be used in an electronic apparatus to connect different components and parts for signal transmission from one circuit board to a control circuit. The male and female mating electrical connectors have different structural designs that are separately fabricated using different molds and by means of different manufacturing processes, thus increasing the cost. When designing male and female electrical connectors, the industry must consider the factors of connector quality, manufacturing cost and connection stability and reliability.

When connecting a male electrical connector and a mating female electrical connector, the male electrical connector and the mating female electrical connector may be attached together in an inaccurate direction due to lack in guide means between the male electrical connector and the mating female electrical connector causing permanent deformation of the conducting terminals or damage of component parts, or connection instability between the conducting terminals of the male electrical connector and the conducting terminals of the female electrical connector.

Further, the electrically insulative connector bodies of a mating pair of male electrical connector and female electrical connector commonly have an enclosed bottom side, and the limited internal space in electrically insulative connector bodies limits the range of elastic deformation of the respective conducting terminals. When forcing the conducting terminals of the male electrical connector into contact with the conducting terminals of the female electrical connector, the conducting terminals are be heavy rubbed, causing damage. Further, after connection between the male electrical connector and the female electrical connector, the conducting terminals of the male electrical connector may be stuck in the conducting terminals of the female electrical connector, leading to further dismounting trouble. Therefore, when designing the electrically insulative connector body of a male or female electrical connector, the industry must consider the space arrangement for conducting terminals that determines low profile characteristic of the connector.

SUMMARY OF THE INVENTION

The present invention has been accomplished under the circumstances in view. It is therefore the main object of the present invention to provide a board-to-board connector, which is made in the form of the combination of a male connector and a female connector, facilitating the manufacturing and installation costs. It is another object of the present invention to provide a board-to-board connector, which avoids structural damage or stuck errors due to inaccurate insertion direction, and provides a foolproof function. It is still another object of the present invention, which enhances electric contact reliability. It is still another object of the present invention, which avoids permanent conducting terminal deformation.

To achieve these and other objects of the present invention, a board-to-board connector comprises an electrically insulative connector body, and a set of first conducting terminals and a set of second conducting terminals respectively mounted in the electrically insulative connector body. The board-to-board connector made in the form of the combination of a male connector and a female connector is disclosed to include an electrically insulative connector body including a long rectangular mating part, a receptacle part and a plug part respectively located at two opposite sides of the long rectangular mating part, a recessed receiving chamber defined between the long rectangular mating part and the receptacle part and a recessed mating chamber defined between the long rectangular mating part and the plug part, terminal grooves located at the receptacle part, a positioning protruding member located at the plug part, and a recessed mating chamber surrounded by the rectangular mating part and the positioning protruding member. The first conducting terminals are respectively mounted in the terminal grooves. The second conducting terminals are respectively mounted in the positioning protruding member of the plug part of the electrically insulative connector body. Thus, two board-to-board connectors of the same design can be respectively installed in two electronic devices and connected together for allowing transmission of signals between the two electronic devices.

Further, the long rectangular mating part of the electrically insulative connector body comprises a longitudinal bottom wall, an upright sidewall extending along one side of the longitudinal bottom wall in parallel to the receptacle part, two upright end walls respectively extended from two distal ends of the first upright wall in direction toward the receptacle part, and a recessed track groove surrounded by the longitudinal bottom wall, the upright sidewall and the upright end walls and disposed in communication with the recessed mating chamber for receiving the longitudinal bottom wall of the long rectangular mating part of an external same structure of board-to-board connector. Subject to the configuration of the long rectangular mating part, two board-to-board connectors of the same design can be accurately connected together, avoiding permanent conducting terminal deformation, structural damage or stuck errors due to inaccurate insertion direction and providing a foolproof function.

Further, the long rectangular mating part of the electrically insulative connector body further comprises a stop block located in each indented space and defining in the respective indented space a receiving groove and a limit groove. The connection arm of each first conducting terminal is received in one respective receiving groove. The bearing tip of each first conducting terminal is positioned in one respective limit groove. Each first conducting terminal further comprises a first raised portion located at an outer surface of the support portion adjacent to the elongated base portion, and a second raised portion located at the contact portion adjacent to the connection arm and facing toward the first raised portion. The first raised portions and second raised portions of the first conducting terminals of one board-to-board connector are respectively clamped on the second conducting terminals of the other board-to-board connector, enhancing electrical connection stability between the two board-to-board connectors.

Further, the long rectangular mating part of the electrically insulative connector body comprises a plurality of indented spaces respectively disposed in communication with the terminal grooves. Each first conducting terminal further comprises a support arm substantially perpendicularly extended from an opposite end of the support portion and terminating in an outwardly extending bonding portion. The contact portion of each first conducting terminal is extended from the suspension arm into one respective indented space. Thus, the mounting arrangement of the first conducting terminals and the second conducting terminals avoids permanent conducting terminal deformation.

DETAILED DESCRIPTION OF THE PREFERRED EMBODIMENT

Figure 1:
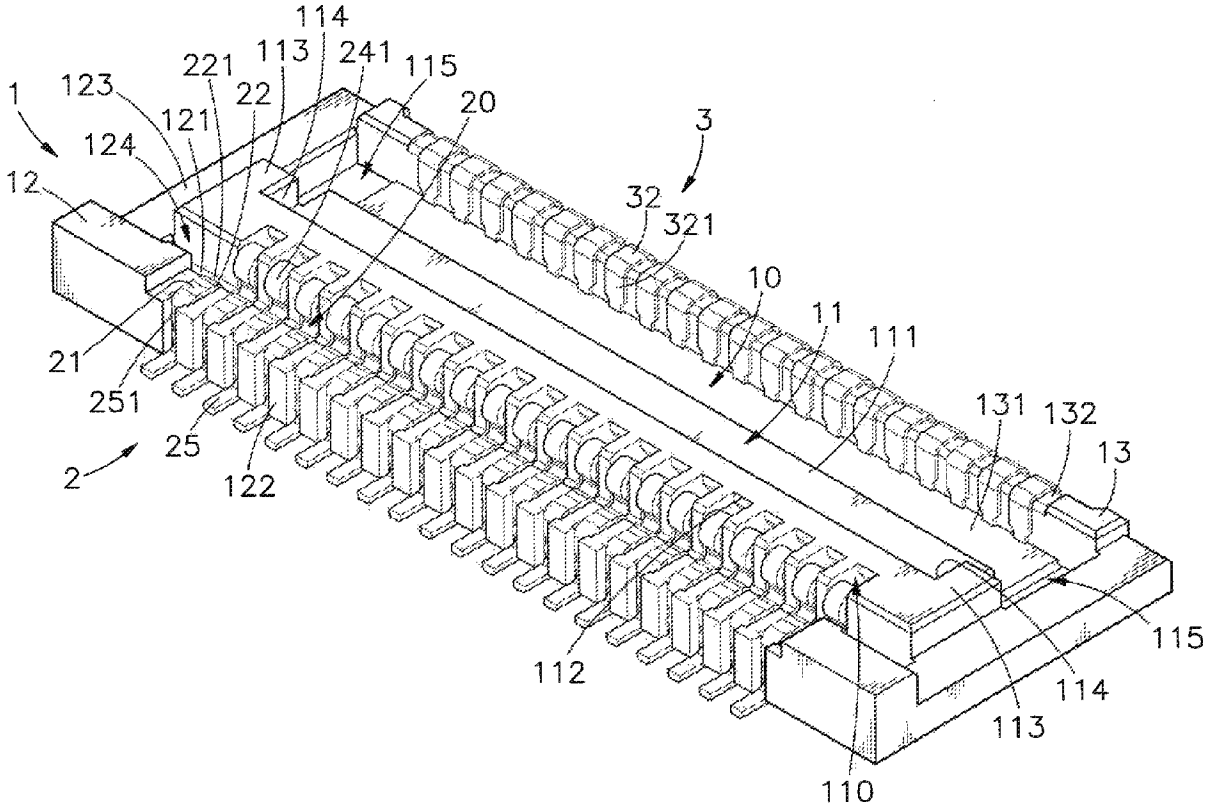
FIG. 1 is an oblique top elevational view of a board-to-board connector in accordance with the present invention.
Figure 2:
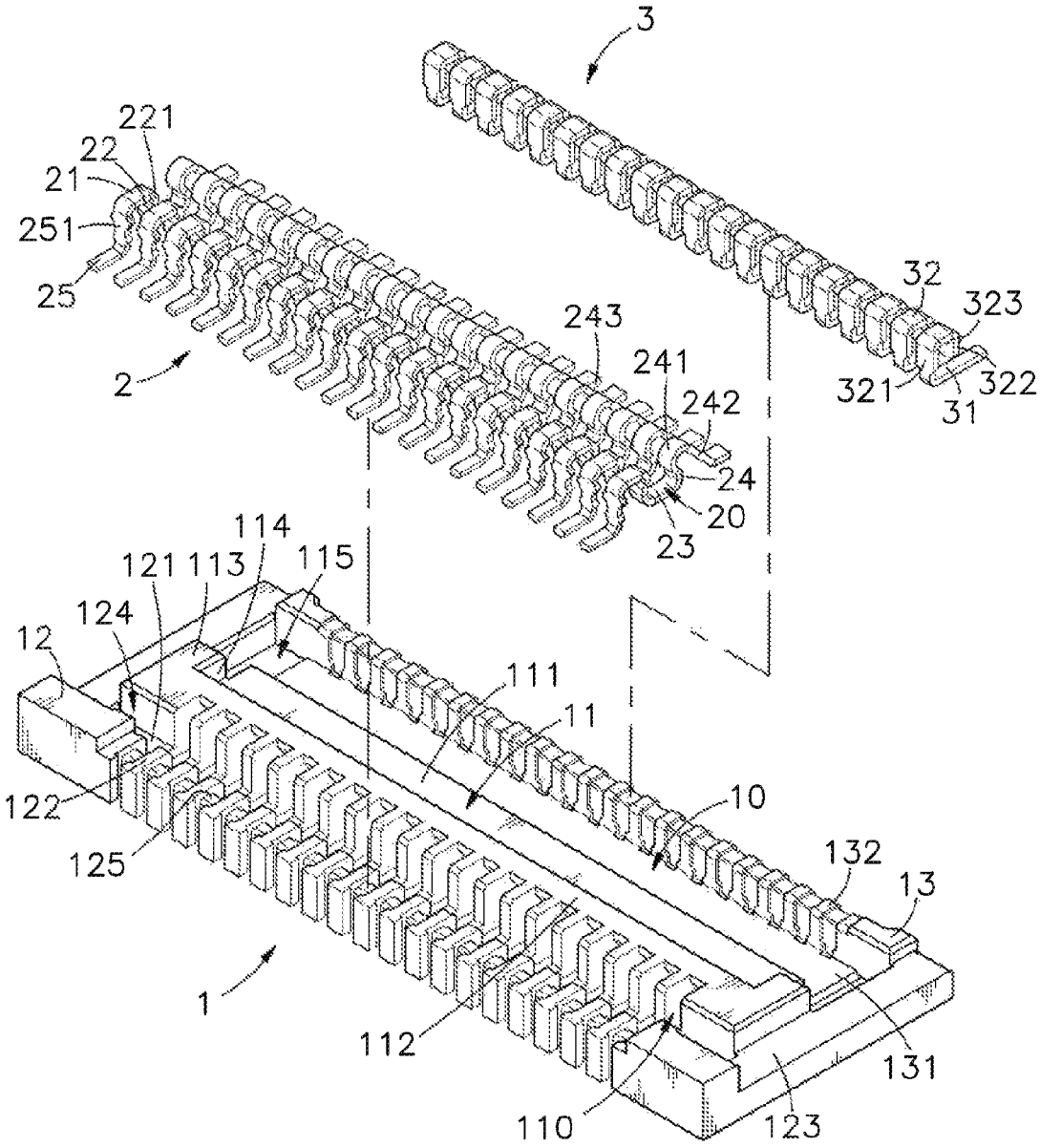
FIG. 2 is an exploded view of the board-to-board connector in accordance with the present invention.
Figure 3:
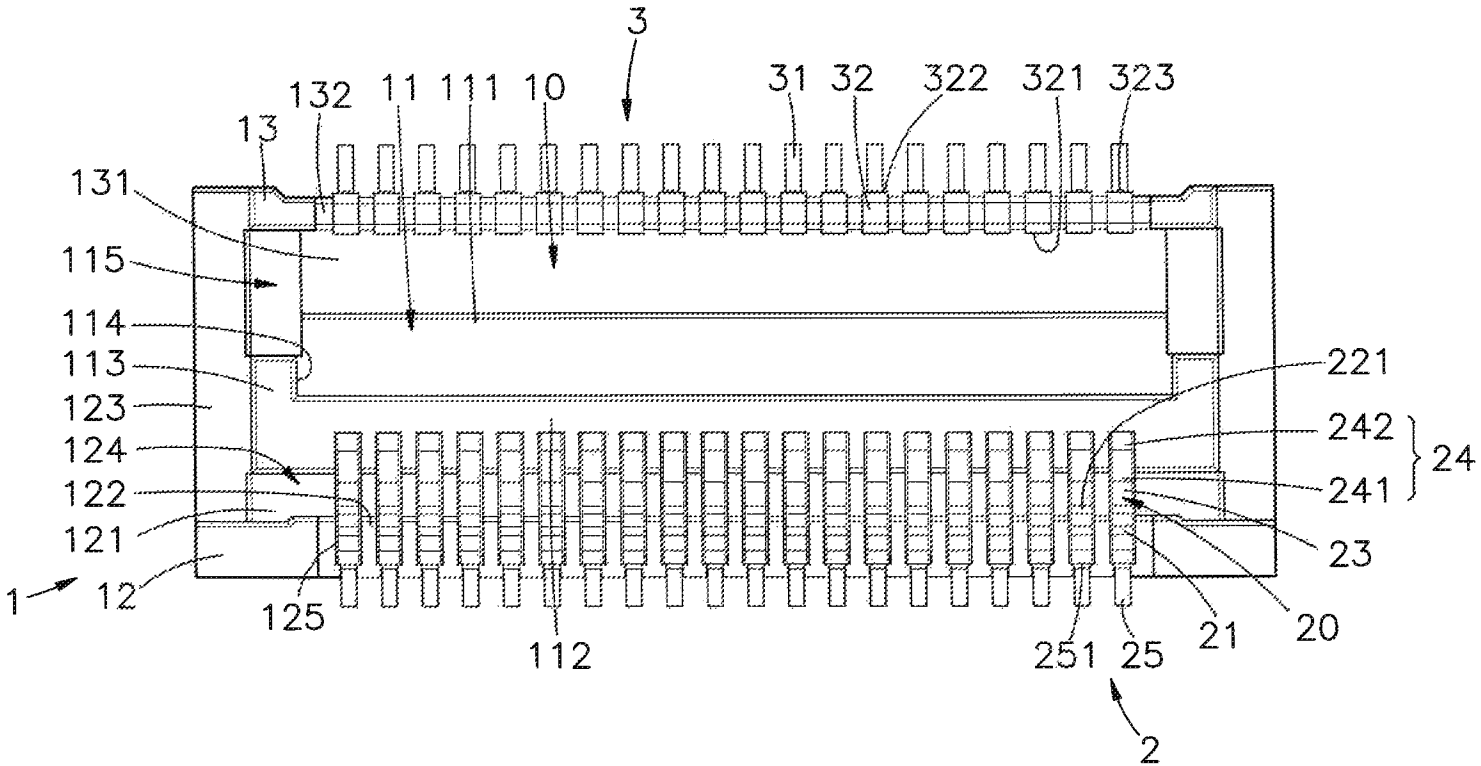
FIG. 3 is a schematic top view of the board-to-board connector in accordance with the present invention.
Figure 4:
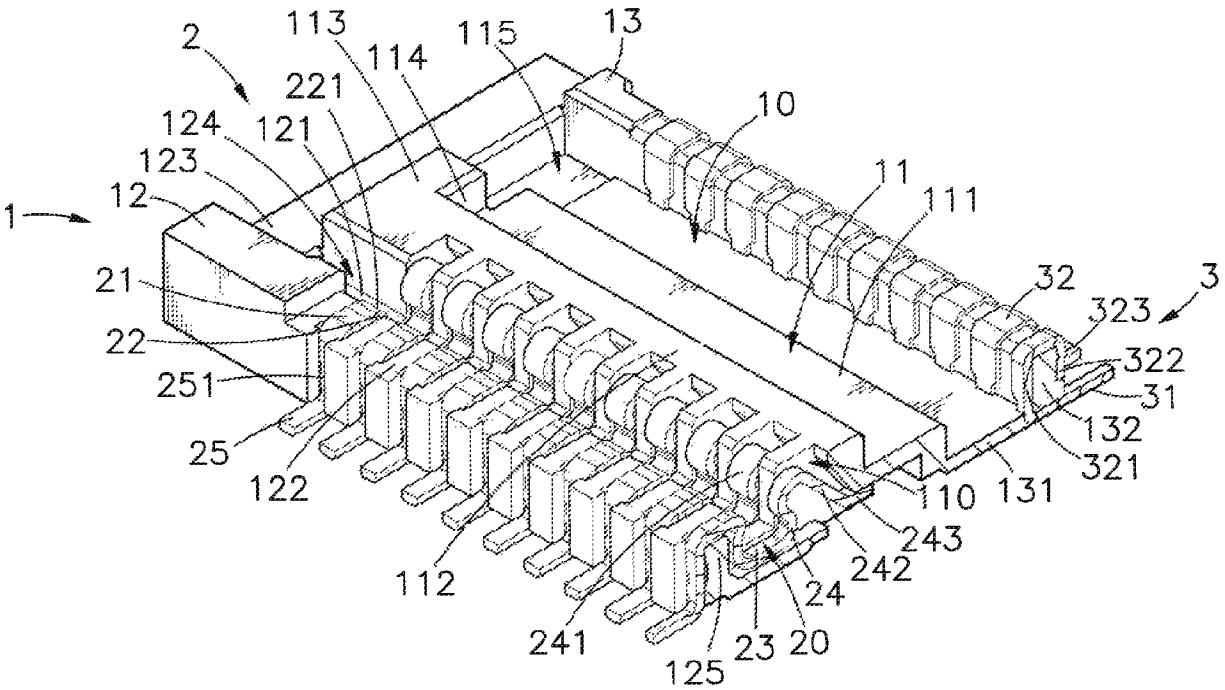
FIG. 4 is a sectional elevation of the board-to-board connector in accordance with the present invention.

Referring to FIGS. 1, 2, 3 and 4, a board-to-board connector in accordance with the present invention is shown. The board-to-board connector comprises an electrically insulative connector body 1, a set of first conducting terminals 2, and a set of second conducting terminals 3.

The electrically insulative connector body 1 comprises a long rectangular mating part 11, a receptacle part 12 located at one side of the long rectangular mating part 11, and a plug part 13 located at an opposite side of the long rectangular mating part 11.

The receptacle part 12 comprises a base panel 121 forwardly extended from the long rectangular mating part 11, a first upright wall 122 perpendicularly upwardly extended from a front side of the base panel 121, two stepped second upright walls 123 respectively extended in a transverse direction from two distal ends of the first upright wall 122 to the plug part 13, a recessed receiving chamber 124 surrounded by the base panel 121, the first upright wall 122, the stepped second upright walls 123 and the long rectangular mating part 11, and a plurality of terminal grooves 125 transversely located at the first upright wall 122 and spaced along the length of the first upright wall 122.

The plug part 13 of the electrically insulative connector body 1 comprises a bottom panel 131 backwardly extended from the long rectangular mating part 11, a positioning protruding member 132 perpendicularly upwardly extended from a rear side of the bottom panel 131 opposite to the receptacle part 12 and connected between the stepped second upright walls 123 of the receptacle part 12 in a parallel manner relative to the first upright wall 122 of the receptacle part 12, and a recessed mating chamber 10 surrounded by the bottom panel 131, the positioning protruding member 132, the long rectangular mating part 11 and the stepped second upright walls 123. Further, the width and length of the positioning protruding member 132 are relatively smaller than the width and length of the recessed receiving chamber 124.

The long rectangular mating part 11 comprises a longitudinal bottom wall 111, an upright sidewall 112 extending along one side of the longitudinal bottom wall 111 in parallel to the first upright wall 122 of the receptacle part 12 and disposed adjacent to the receptacle part 12 and remote from the plug part 13, two upright end walls 113 respectively extended from two distal ends of the upright sidewall 112 in direction toward the receptacle part 12 and respectively abutted at respective inner sides of the stepped second upright walls 123, a recessed track groove 114 surrounded by the longitudinal bottom wall 111, the upright sidewall 112 and the upright end walls 113 and disposed in communication with the recessed mating chamber 10, two open spaces 115 respectively disposed between the upright end walls 113 and the positioning protruding member 132 of the plug part 13, a plurality of indented spaces 110 located at the upright sidewall 112 and spaced along the length of the upright sidewall 112 and respectively disposed in communication with the terminal grooves 125, and a stop block 126 located in each indented space 110 (see FIG. 5) and defining in the respective indented space 110 a receiving groove 127 and a limit groove 128. Further, the width of the upright end walls 113 is smaller than the width of the longitudinal bottom wall 111.

The first conducting terminals 2 are respectively mounted in the terminal grooves 125 of the receptacle part 12 of the electrically insulative connector body 1. Each first conducting terminals 2 comprises an elongated base portion 21 positioned in one terminal groove 125 of the receptacle part 12 of the electrically insulative connector body 1, a support portion 22 curved from one end of the elongated base portion 21, a suspension arm 23 obliquely upwardly extended from one end of the support portion 22 opposite to the elongated base portion 21 toward one respective indented space 110, a first raised portion 221 located at an outer surface of the support portion 22 adjacent to the elongated base portion 21, a contact portion 24 extended from one end of the suspension arm 23 opposite to the elongated base portion 21, a bearing tip 243 stopped against the stop block 126 in one indented space 110, a connection arm 242 connected between the contact portion 24 and the bearing tip 243, a second raised portion 241 located at the contact portion 24 adjacent to the connection arm 242 and facing toward the first raised portion 221, a support arm 251 substantially perpendicularly extended from the other end of the elongated base portion 21 and terminating in an outwardly extending bonding portion 25. Further, the support portion 22, the suspension arm 23 and the contact portion 24 define a flexible space 20.

The second conducting terminals 3 are fixedly mounted in the positioning protruding member 132 of the plug part 13 of the electrically insulative connector body 1 along its length by insert molding. Each second conducting terminals 3 comprises a base portion 31, a connection portion 32 disposed in a substantially parallel manner relative to the base portion 31, a first arm portion 321 connected between one end of the base portion 31 and one end of the connection portion 32, a second arm portion 322 perpendicularly extended from the other end of the connection portion 32 and disposed in a parallel manner relative to the first arm portion 321, and a protruded retaining portion 323 located at an outer side of the second arm portion 322.

During installation, position the first conducting terminals 2 in the respective terminal grooves 125 of the receptacle part 12 of the electrically insulative connector body 1 to hold the respective support portions 22 in the respective recessed receiving chambers 124, the respective suspension arms 23 on the base panel 121 of the receptacle part 12 and the respective contact portions 24 in the respective indented spaces 110, suspending the respective first raised portions 221 and second raised portions 241 in the recessed receiving chamber 124 and enabling the respective bearing tips 243 to be stopped against respective stop blocks 126 in the respective indented spaces 110, the respective support arms 251 to be supported on the first upright wall 122 and the respective bonding portions 25 to be extended horizontally out of the electrically insulative connector body 1.

The base portions 31 of the second conducting terminals 3 are fixedly mounted in the plug part 13 of the electrically insulative connector body 1 by insert molding, enabling the first arm portions 321 to extend upwardly along the inner side of the positioning protruding member 132 into the recessed mating chamber 10, the connection portions 32 to be supported on the topmost edge of the positioning protruding member 132 and the second arm portions 322 to clamp on the outer side of the positioning protruding member 132.

It is to be noted that installing the second conducting terminals 3 in the plug part 13 of the electrically insulative connector body 1 by insert molding is simply one installation example of the present invention. Any other known mounting techniques can be selectively used to install the second conducting terminals 3 in the plug part 13 of the electrically insulative connector body 1.

Figure 5:
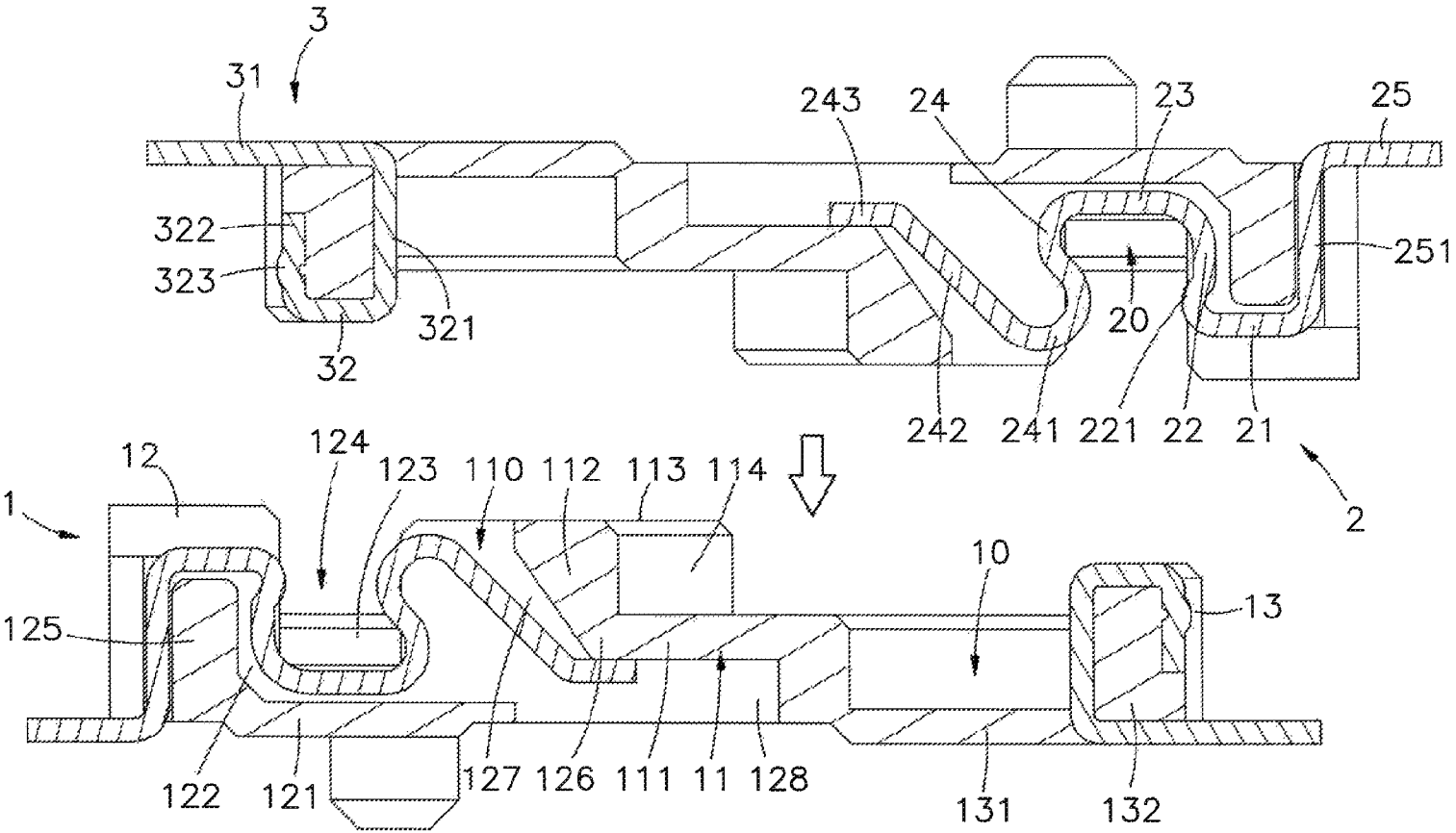
FIG. 5 is an applied view of the present invention, illustrating connection between two board-to-board connectors (I).
Figure 6:
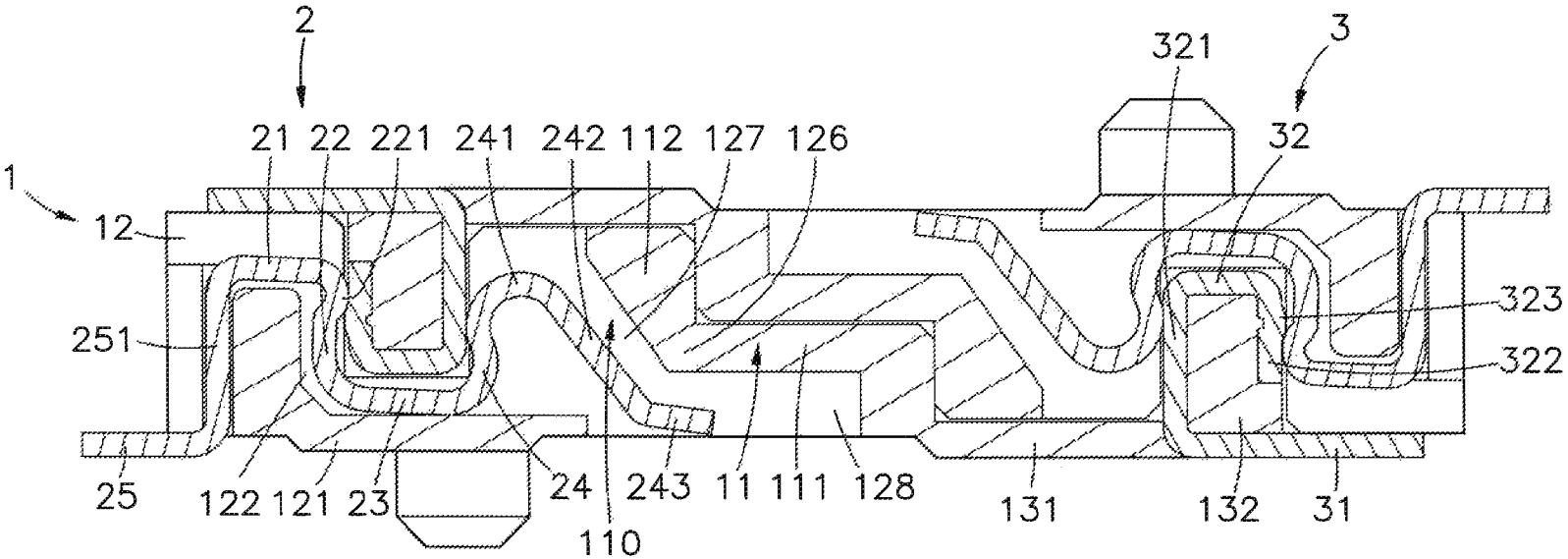
FIG. 6 is an applied view of the present invention, illustrating connection between two board-to-board connectors (II).

Referring to FIGS. 5 and 6 and FIGS. 2 and 3 again, the first conducting terminals 2 and the second conducting terminals 3 are respectively installed in the receptacle part 12 and plug part 13 of the electrically insulative connector body 1 such that the board-to-board connector can be used at a male connector side as well as a female connector side in an electronic system, saving the connector manufacturing cost. This design of board-to-board connector has the characteristics of high level of structural stability and reliability and ease of installation. The mounting arrangement of the first conducting terminals 2 and the second conducting terminals 3 avoids permanent conducting terminal deformation.

Further, during application of the present invention, the bonding portions 25 of the first conducting terminals 2 and the base portions 31 of the second conducting terminals 3 are respectively bonded to a circuit board (not shown) by SMT or through hole technology. The application of SMT mounting technology facilitates rapid production and quality control.

When connecting two board-to-board connectors that are configured subject to the present invention and respectively disposed at the male connector side and female connector side in an electronic system, aim the long rectangular mating part 11 of the electrically insulative connector body 1 of one board-to-board connector at the recessed mating chamber 10 of the other board-to-board connector, and then insert the plug part 13 of one board-to-board connector into the receptacle part 12 of the other board-to-board connector. At this time, the longitudinal bottom wall 111 of one board-to-board connector is moved along the recessed track groove 114 of the other board-to-board connector into the recessed mating chamber 10 of the other board-to-board connector, the upright sidewall 112 of one board-to-board connector is stopped at the longitudinal bottom wall 111 of the other board-to-board connector, the upright end wall 113 of one board-to-board connector is engaged into the open space 115 of the other board-to-board connector, the stepped second upright wall 123 of one board-to-board connector is abutted against the stepped second upright wall 123 of the other board-to-board connector, the positioning protruding member 132 of one board-to-board connector is engaged into the recessed receiving chamber 124 of the other board-to-board connector, and the first upright wall 122 of one board-to-board connector is disposed at an outer side relative to the positioning protruding member 132 of the other board-to-board connector, keeping the respective first conducting terminals 2 of one board-to-board connector in positive contact with the respective second conducting terminals 3 of the other board-to-board connector. Subject to the configuration of the long rectangular mating parts 11, the two board-to-board connectors can be accurately connected together, avoiding permanent conducting terminal deformation, structural damage or stuck errors due to inaccurate insertion direction and providing a foolproof function.

When attaching the second conducting terminals 3 of one board-to-board connector to the first conducting terminals 2 of the other board-to-board connector, the first arm portions 321 and second arm portions 322 of the second conducting terminals 3 of one board-to-board connector are respectively stopped against the second raised portions 241 of the contact portions 24 and first raised portion 221 of the support portions 22 of the first conducting terminals 2 of the other board-to-board connector, enabling the contact portions 24 to be elastically deformed and moved relative to the respective elongated base portions 21 in direction from the respective terminal grooves 125 toward the respective indented spaces 110, forcing the respective connection arms 242 downwardly along the respective receiving grooves 127 to engage the respective bearing tips 243 into the respective limit grooves 128. Thus, the displacement range of the first conducting terminals 2 in elastic deformation is greatly enhanced. At this time, the suspension arms 23 of the first conducting terminals 2 are respectively stopped against the bottom surfaces of the respective terminal grooves 125 to limit the range of elastic deformation of the first conducting terminals 2 and to support the respective contact portions 24 in the respective indented spaces 110, avoiding permanent conducting terminal deformation or structural damage.

After the connection portions 32 of the second conducting terminals 3 of one board-to-board connector entered the respective flexible spaces 20 defined in the first conducting terminals 2 of the other board-to-board connector, the first raised portions 221 and second raised portions 241 of the first conducting terminals 2 of one board-to-board connector are respectively clamped on the second arm portions 322 and first arm portions 321 of the second conducting terminals 3 of the other board-to-board connector to achieve electric connection between the two board-to-board connectors, and the protruded retaining portions 323 of the second conducting terminals 3 of one board-to-board connector are respectively forced into engagement with the respective first raised portions 221 of the first conducting terminals 2 of the other board-to-board connector, enabling the user's hand to sense accurate positioning between the two board-to-board connectors. This installation operation is easy and highly reliable, assuring signal transmission reliability.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A board-to-board connector, comprising:

an electrically insulative connector body comprising a long rectangular mating part, a receptacle part located at one side of said long rectangular mating part, a plug part located at an opposite side of said long rectangular mating part, a recessed receiving chamber defined between said long rectangular mating part and said receptacle part and a recessed mating chamber defined between said rectangular mating part and said plug part, said receptacle part comprising a plurality of terminal grooves, said plug part comprising a positioning protruding member, which defines with said long rectangular mating part, said recessed mating chamber;

a set of first conducting terminals respectively mounted in said terminal grooves of said electrically insulative connector body, each said first conducting terminal comprising an elongated base portion positioned in one said terminal groove of said electrically insulative connector body, a support portion curved from one end of said elongated base portion, a suspension arm obliquely upwardly extended from one end of said support portion opposite to said elongated base portion and inserted into said recessed receiving chamber, a contact portion extended from one end of said suspension arm opposite to said elongated base portion, a bearing tip, a connection arm connected between said contact portion and said bearing tip, and a flexible space surrounded by said support portion, said suspension arm and said contact portion; and a set of second conducting terminals mounted in said positioning protruding member of said plug part of said electrically insulative connector body, each said second conducting terminal comprising a base portion and a connection portion insertable into the flexible space of an external same structure of board-to-board connector into electrical contact with one respective first conducting terminal of said external same structure of board-to-board connector.

2. The board-to-board connector as claimed in claim 1, wherein each said first conducting terminal further comprises a first raised portion located at an outer surface of said support portion adjacent to said elongated base portion, and a second raised portion located at said contact portion adjacent to said connection arm and facing toward said first raised portion.

3. The board-to-board connector as claimed in claim 1, wherein each said second conducting terminal further comprises a first arm portion connected between one end of said base portion and one end of said connection portion, and a second arm portion perpendicularly extended from an opposite end of said connection portion.

4. The board-to-board connector as claimed in claim 1, wherein said long rectangular mating part of said electrically insulative connector body comprises a longitudinal bottom wall, an upright sidewall extending along one side of said longitudinal bottom wall in parallel to said receptacle part, two upright end walls respectively extended from two distal ends of said first upright wall in direction toward said receptacle part, said upright end walls having a width smaller than the width of said longitudinal bottom wall, and a recessed track groove surrounded by said longitudinal bottom wall, said upright sidewall and said upright end walls and disposed in communication with said recessed mating chamber for receiving the longitudinal bottom wall of the long rectangular mating part of said external same structure of board-to-board connector.

5. The board-to-board connector as claimed in claim 4, wherein said long rectangular mating part of said electrically insulative connector body further comprises two open spaces respectively disposed between said upright end walls and said positioning protruding member of said plug part receptacle part for receiving the upright end walls of the long rectangular mating part of the electrically insulative connector body of said external same structure of board-to-board connector.

6. The board-to-board connector as claimed in claim 1, wherein said receptacle part of said electrically insulative connector body comprises a base panel forwardly extended from said long rectangular mating part, a first upright wall perpendicularly upwardly extended from a front side of said base panel, and two stepped second upright walls respectively extended in a transverse direction from two distal ends of said first upright wall to said plug part; said plug part of said electrically insulative connector body further comprises a bottom panel extended from said long rectangular mating part and connected to said positioning protruding member.

7. The board-to-board connector as claimed in claim 6, wherein said terminal grooves are longitudinally and equally spaced along said receptacle part and extending from said first upright wall to said long rectangular mating part.

8. The board-to-board connector as claimed in claim 6, wherein said positioning protruding member is connected between said stepped second upright walls of said receptacle part in a parallel manner relative to said first upright wall of said receptacle part, the width and length of said positioning protruding member being relatively smaller than the width and length of said recessed receiving chamber.

9. The board-to-board connector as claimed in claim 1, wherein said long rectangular mating part of said electrically insulative connector body comprises a plurality of indented spaces respectively disposed in communication with said terminal grooves; each said first conducting terminal further comprises a support arm substantially perpendicularly extended from an opposite end of said support portion and terminating in an outwardly extending bonding portion, the contact portion of each said first conducting terminal being extended from said suspension arm and inserted into one said indented space.

10. The board-to-board connector as claimed in claim 9, wherein said long rectangular mating part of said electrically insulative connector body further comprises a stop block located in each said indented space and defining in the respective said indented space a receiving groove and a limit groove; the connection arm of each said first conducting terminal is received in one respective said receiving groove and the bearing tip of each said first conducting terminal is positioned in one respective said limit groove.

11. The board-to-board connector as claimed in claim 9, wherein each said first conducting terminal further comprises a first raised portion located at an outer surface of said support portion adjacent to said elongated base portion, and a second raised portion located at said contact portion adjacent to said connection arm and facing toward said first raised portion.

12. The board-to-board connector as claimed in claim 11, wherein each said second conducting terminal further comprises a protruded retaining portion located at an outer side of said second arm portion; said first arm portion and said second arm portion of each said second conducting terminal are disposed in parallel.

* * * * *